United States Patent [19]

Barrison

[11] 4,005,558

[45] Feb. 1, 1977

[54] EXTRUDED DOOR FRAME

[76] Inventor: John Albert Barrison, 670 Hampden Place, Pacific Palisades, Calif. 90272

[22] Filed: June 7, 1976

[21] Appl. No.: 693,310

[52] U.S. Cl. ..... 52/213; 49/504

[51] Int. Cl.[2] ..... E06B 1/04

[58] Field of Search ..... 52/204, 208, 212–217, 52/716; 49/504, 505

[56] References Cited

UNITED STATES PATENTS

| | | | |
|---|---|---|---|
| 1,744,732 | 1/1930 | Baum | 52/212 |
| 3,345,780 | 10/1967 | McGhee | 52/213 X |
| 3,354,586 | 11/1967 | Den Besten | 49/504 |
| 3,654,734 | 4/1972 | Lehman | 52/213 X |

FOREIGN PATENTS OR APPLICATIONS

| | | | |
|---|---|---|---|
| 635,299 | 1/1964 | Belgium | 49/504 |
| 1,094,656 | 12/1967 | United Kingdom | 49/504 |

*Primary Examiner*—J. Karl Bell
*Attorney, Agent, or Firm*—Ralph B. Pastoriza

[57] ABSTRACT

The extruded frame includes an elongated strip which may be transversely cut to provide left, right and top frame portions for a door opening. Each strip has an identical configuration in cross section which includes opposite longitudinal edges rearwardly extending from the face of the strip at right angles to straddle a trimmer or header as the case may be. Integrally formed finishing flanges laterally extend from intermediate points on the rearwardly extending longitudinal edges to provide a finishing trim for dry wall. A door stop is formed from the sheet along the front face intermediate the longitudinal edges. In addition, pairs of ribs extend rearwardly from the face on either side of the door stop portion and serve as backing stops in the milled out openings provided for hinges and striker plate hardware, the ribs maintaining the hinge leaves and striker plate surfaces flush with the face of the extruded frame.

5 Claims, 5 Drawing Figures

EXTRUDED DOOR FRAME

This invention relates generally to construction operations and more particularly to an improved extruded door frame facilitating the installation of doors in wall openings.

BACKGROUND OF THE INVENTION

Providing extruded metal strips to serve as door frames is well known in the prior art. The extruded strip itself is cut to proper length to fit against the left and right door jambs or trimmer and also the top header. In order to accommodate the door hinges and strike plate hardware, openings are formed in the left and right strips to receive the hinge leaves and strike plate in such a manner that their surfaces will be flush with the face of the strips. In this latter respect, a backing plate has been provided behind the cut out openings in order that the hinge leaves and striker plates will be retained in flush position and the provision of this backing plate together with appropriate means for supporting the same to the rear of the strip face not only increases the actual cost of the door frame but in addition requires additional time for installing the door.

It would be helpful in the provision of extruded metal strips to serve as door frames if some way could be provided to eliminate the necessity of a backing plate to support the hinge leaves and striker plate in flush relationship with the face of the strips. It would also be desirable to provide a door frame strip which serves not only the function of a door stop for framing the door but includes finishing surfaces or flanges for the adjacent dry wall.

BRIEF DESCRIPTION OF THE PRESENT INVENTION

With the foregoing considerations in mind, the present invention contemplates an improved extruded door frame so designed as to eliminate the necessity of backing plates in the like for cut out openings accommodating the door hardware and further combines with the door stop portion itself appropriate finishing flanges for adjacent dry wall.

Basically, the invention contemplates with the normally extruded portions, extruded pairs of ribs running longitudinally on either side of the door stop portion of the strip extending rearwardly from the face such that portions of the ribs are exposed when cut out openings are formed to accommodate the door hardware. These exposed portions of the ribs serve the function of the heretofore provided backing plate but since they constitute an integral part of the extruded strip, it is not necessary to provide a separate backing plate together with appropriate means for supporting the same to the rear face of the strip at the cut out openings.

In addition, integrally formed laterally extending finishing flanges are provided on the longitudinal edges for engaging the end of dry walls on either side of the door opening thereby providing a neat finished appearance.

BRIEF DESCRIPTION OF THE DRAWINGS

A better understanding of this invention will be had by referring to the accompanying drawings in which.

DETAILED DESCRIPTION OF THE PREFERRED EMBODIMENT

Figure 1:
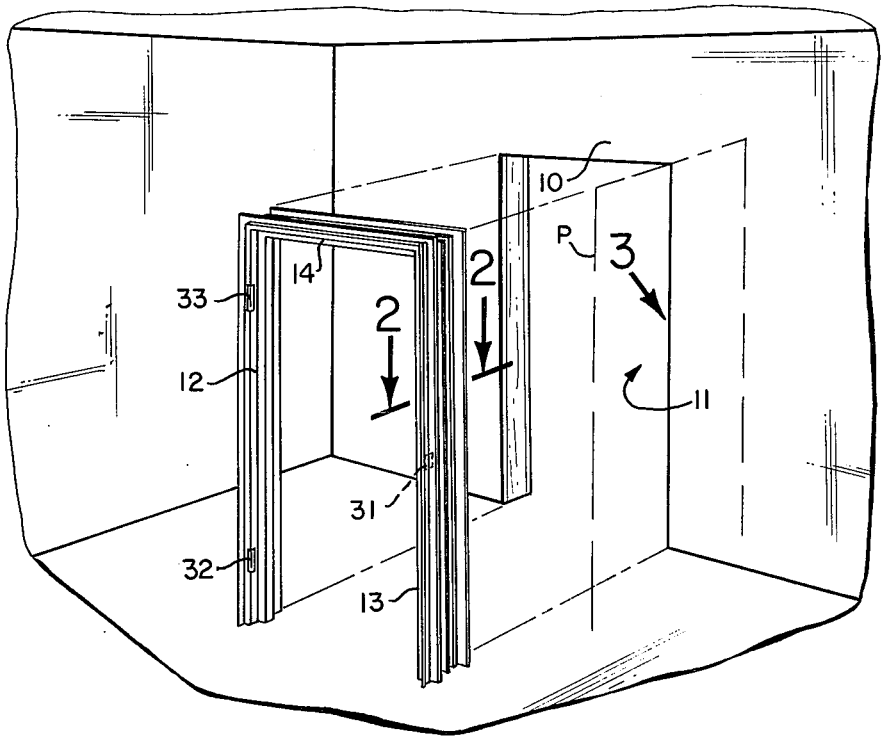
FIG. 1 is a perspective view of a door opening showing the extruded door frame of this invention exploded away from the opening.

Referring first to FIG. 1, there is shown a wall 10 of an office or dwelling having a door opening 11. The extruded door frame of this invention is formed by a single extruded metal strip cut to provide a left frame strip 12, a right frame strip 13, and a top strip 14 shown in FIG. 1 in assembled relationship but exploded away from the opening 11.

Since the frame portions are formed from a single extruded metal strip, each has an identical configuration when viewed in transverse cross section. Thus, considering the right extruded strip 13 which has its front face lying essentially in a vertical plane P indicated in dashed lines in FIG. 1 normal to the plane of the opening, reference is had to the showing of FIG. 2 taken in the direction of the arrows 2—2 of FIG. 1.

Figure 2:
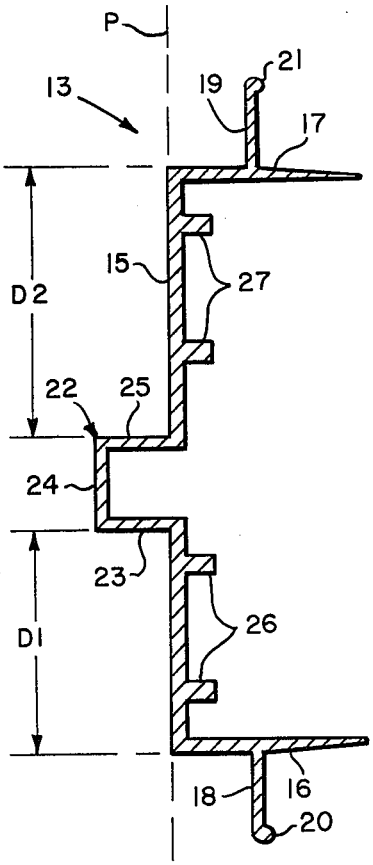
FIG. 2 is an enlarged cross section of one of the extruded frame portions looking in the direction of the arrows 2—2 of FIG. 1.

In FIG. 2, the face of the strip is shown at 15, the cross sectional configuration including opposed longitudinal edges 16 and 17 rearwardly extending from the face 15 at right angles to the referred to vertical plane P reproduced in FIG. 2 and understood to be normal to the plane of the drawing. These rearwardly extending opposite longitudinal edges will straddle the conventional trimmer constituting the right hand door jamb as will become clearer as the description proceeds.

As shown in FIG. 2, the rearwardly extending longitudinal edges 16 and 17 include integrally formed finishing flanges 18 and 19 extending laterally outwardly from intermediate points on the edges, these flanges terminating in slight rearwardly extending beads 20 and 21 to engage about the ends of dry wall normally provided on opposite sides of the door opening 11 of FIG. 1. The manner in which these finishing flanges cooperate with the dry wall will also become clearer as the description proceeds.

A door stop portion 22 is formed in the front face 15 of the strip by a portion 23 extending forwardly at right angles from the vertical plane P, thence parallel to the plane as at 24 and thence rearwardly at right angles to the plane as at 25, the door stop portion lying parallel to and intermediate the opposied longitudinal edges 16 and 17.

The extrusion of FIG. 2 is completed by the provision of two pairs of parallel ribs 26 and 27, one pair on each side of the door stop 22 and extending rearwardly a given distance at right angles to the vertical plane P, the ribs running parallel to the edges of the strip.

In the preferred embodiment of the extrusion illustrated in FIG. 2, the distance of the door stop portion 22 from one longitudinal edge such as the edge 16 designated D1 is different from the distance of the stop portion 22 from the opposite longitudinal edge 17, this latter distance being indicated at D2. The distances D1 and D2 correspond to the two different thicknesses of two standard types of doors and thus the single extrusion is capable of accommodating the available two different thicknesses of doors.

Figure 3:
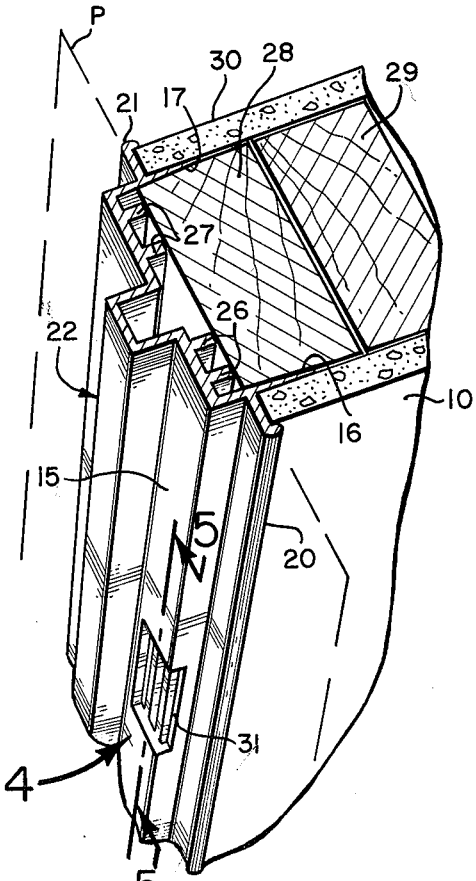
FIG. 3 is a fragmentary perspective view of one of the frame portions of FIG. 1 installed against a trimmer constituting part of the door jamb.

Referring now to the fragmentary perspective view of FIG. 3 which illustrates the right extruded frame portion 13 positioned in the right portion of the door opening 11, it will be noted that the pairs of ribs 26 and 27 abut against the face of the normally provided trimmer 28 constituting part of the door jamb. The trimmer 28 is shown in turn secured to the conventional stud 29. The dry wall on the opposite side of the opening 11 corresponding to the wall 10 is shown at 30 and it will be noted that the ends of the respective dry walls are engaged by the head portions 20 and 21 of the finishing flanges to provide a neat finished appearance.

In order to accommodate the door hardware such as the striker plate which would be provided on the right extruded frame portion 13, there is milled out an opening 31 in the face 15 of the strip. The milling operation, however, only extends to the exact thickness of the hardware so that the portions of the integrally formed pairs of ribs 26 running past the milled opening are exposed. These portions of the ribs serve as a stop backing for the strike plate when inserted in the opening 31 so that the front surface of the strike plate will be exactly flush with the front face 15 of the extruded strip. It will thus be evident that no additional hardware in the form of a backing plate together with appropriate means for mounting the same to the rear of the milled out opening 31 is necessary.

It will be understood that similar milled out openings are provided on the left strip 12 of FIG. 1 to accommodate the hinges, these latter openings being indicated in FIG. 1 at 32 and 33. The header extruded strip 14 of course, will not require any milled out openings. The pairs of ribs, however, serve the additional function of stabilizing the positioning of the strips against the left and right trimmers as well as the strip portion running across the top to the header.

Figure 4:
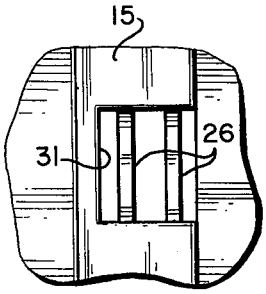
FIG. 4 is a fragmentary front elevational view of a portion of the extruded strip looking in the direction of the arrow 4 of FIG. 3; and, FIG. 5 is a fragmentary cross section taken in the direction of the arrows 5—5 of FIG. 3.

FIG. 4 clearly illustrates the exposed portions of the ribs 26 extending past the rear portion of the opening 31 formed in the face 15 of the strip of FIG. 3.

Figure 5:
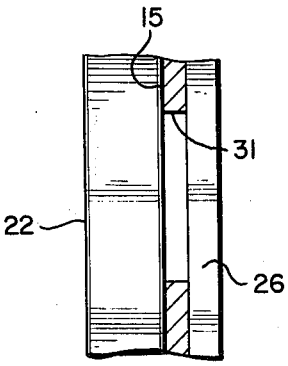

In the cross section of FIG. 5 through the opening 31, it will be evident that the milled opening extends only to the thickness of the extruded strip itself leaving the rib 26 in its initial condition so that its exposed front surface functions as a backing for the inserted hardware.

OPERATION

In the operation of the present invention, a special extrusion die is provided with the configuration shown and described with respect to FIG. 2. Metal is then extruded through the die to provide an elongated strip. This strip may then be cut to provide the left, right and top frame portions described in FIG. 1. Thereafter, appropriate hardware receiving openings such as indicated at 31, 32 and 33 are formed in the faces of the left and right strips to one side of the door stop 22 described in FIG. 2 depending upon the thickness of the door to be installed.

The respective extruded frame portions are then installed against the left and right trimmers and header board respectively as illustrated in FIG. 3 for the right hand frame portion and trimmer 28. Appropriate nails or other fastening means may simply be driven into the rearwardly extending longitudinal edges 16 and 17 to the rear of the finishing flanges 18 and 19 to secure the extruded strip to the trimmer 28. When the dry walls 10 and 30 are positioned they will be received in the finishing flange portions 18 and 19 described in FIG. 2, the finishing beads 20 and 21 engaging about the outer end edges of the dry wall to provide the heretofore referred to finished appearance. As mentioned, the pairs of ribs 26 and 27 will stabilize the strip against the front face of the trimmer 28; that is, assure that the same is parallel thereto.

After assembly of the various extruded strips within the door frame, the striker plate and hinge hardware will be installed within the cut out openings 31, 32 and 33, the exposed portion of the ribs passing the rear of these openings assuring that the front surfaces of the hardware will be flush with the face 15 of the strips all as described heretofore.

In the preferred embodiment described in FIG. 2, the rearwardly extending end portions of the longitudinal edges 16 and 17 are tapered to meet the opposed inner portions of the dry wall 10 and 30 adjacent the ends engaged by the flanges.

While the door frame has been described herein as an extruded metal strip it could equally as well constitute an extruded plastic strip. Thus, the term "strip" as used herein is meant to include either extruded metal or extruded plastic.

From all of the foregoing, it will thus be evident that the present invention has provided an improved extruded type door frame which eliminates the problems of providing backing plates and the like as heretofore required with such frames and further assures a neat and finished appearance after installation.

What is claimed is:

1. An extruded door frame including left, right and top elongated extruded strips each of identical configurations when viewed in transverse cross section, the right extruded strip having its face lying in a vertical plane normal to the plane of the door opening for abutment against the right door jamb trimmer and having, when viewed in top transverse cross section:

a. opposite longitudinal edges rearwardly extending from said face at right angles to said vertical plane to straddle said trimmer, said edges including integrally formed finishing flanges extending laterally outwardly from intermediate points on the rearwardly extending portions of said edges, b. a door stop portion formed in the front face of the strip by a portion extending forwardly at right angles from the vertical plane, thence parallel to said plane and thence rearwardly at right angles to said plane, said door stop portion lying parallel to and intermediate said opposite longitudinal edges, and c. two pairs of parallel ribs, one pair on each side of said door stop, extending rearwardly a given distance at right angles to said vertical plane and running parallel to the longitudinal edges of the strip to abut against the face of said trimmer and stabilize said strip in its secured position.

2. A door frame according to claim 1, in which surface portions of the front face of the left and right extruded strips are milled away to leave openings for accommodating hinges and a strike plate as may be required for a door, said ribs providing a backing stop at the portions thereof running past the milled openings so that the hinges and strike plate are held in flush relationship to the face of the corresponding strips when positioned in the openings.

3. A door frame according to claim 1, in which said integrally formed finishing flanges terminate in small rearwardly extendings beads for engagement about the ends of dry wall on opposite sides of a wall stud against which the trimmer is secured.

4. A door frame according to claim 1, in which the distance of said door stop portion from one longitudinal edge is different from the distance of said door stop portion from the opposite longitudinal edge, these distances respectively correspond to the thicknesses of two types of standard doors of different thicknesses whereby the extruded door frame is adaptable for use with either type of standard door.

5. A door frame according to claim 1, in which the portions of said opposite longitudinal edges straddling said trimmer taper in thickness to meet said dry wall adjacent the end engaging said finishing flanges.

* * * * *